128-24 A AU 337 CX
11/24/87 OR 4,708,127

United States Patent [19]

Abdelghani

[11] Patent Number: 4,708,127

[45] Date of Patent: Nov. 24, 1987

[54] ULTRASONIC GENERATING SYSTEM WITH FEEDBACK CONTROL

[75] Inventor: Ali A. Abdelghani, Duarte, Calif.

[73] Assignee: The Birtcher Corporation, El Monte, Calif.

[21] Appl. No.: 790,744

[22] Filed: Oct. 24, 1985

[51] Int. Cl.[4] ..... A61H 1/00

[52] U.S. Cl. ..... 128/24 A; 310/319

[58] Field of Search ..... 128/24 A, 303 R, 660; 604/22, 43; 318/23, 25, 37, 89, 114, 116, 118; 331/1 R, 155–158, 163; 366/127; 433/86; 310/316–319

[56] References Cited

U.S. PATENT DOCUMENTS

| | | | |
|---|---|---|---|
| Re. 28,752 | 3/1976 | Balamuth et al. | 128/24 A X |
| 2,444,349 | 6/1948 | Harrison | 128/24 A |
| 2,799,787 | 7/1957 | Güttner et al. | 128/24 A |
| 3,828,769 | 8/1974 | Mettler | 128/24 A |
| 3,924,335 | 12/1975 | Balamuth et al. | 128/24 A X |
| 4,122,427 | 10/1978 | Karsh | 128/721 X |
| 4,168,628 | 9/1979 | Vilkomerson | 128/660 X |
| 4,223,676 | 9/1980 | Wuchinich et al. | 128/24 A X |
| 4,368,410 | 1/1983 | Hance et al. | 128/24 A X |
| 4,532,933 | 8/1985 | Hokanson | 128/660 |
| 4,583,529 | 4/1986 | Briggs | 128/24 A |

FOREIGN PATENT DOCUMENTS 2821465 11/1978 Fed. Rep. of Germany ... 128/24 A

OTHER PUBLICATIONS

Hartl, J. et al., "Automatic Dose Meter and Control Circuit Arrangement", Intnl. Appln. published as PCT Publ., No. WO82/03779, Publ. Date Nov. 11, 1982.

Frederick, J. R. "Ultrasonic Engineering", pp. 109–115, 346–349, ©1965, John Wiley & Sons, N.Y. & London.

*Primary Examiner*—Kyle L. Howell
*Assistant Examiner*—Francis J. Jaworski
*Attorney, Agent, or Firm*—Jackson & Jones

[57] ABSTRACT

An ultrasonic generating system for coupling vibrating energy into a load, such as living tissue, has been described which employs a piezoelectric crystal having excitation electrodes on opposite faces thereof. A feedback electrode is disposed on one face of the crystal adjacent to and insulated from one of the excitation electrodes to provide a feedback signal between the feedback electrode and the other excitation electrode. A power supply is provided for applying excitation energy to the excitation electrodes. The feedback signal is utilized to slave the frequency of the power supply voltage to the resonant frequency of the crystal and to disable the power supply when the impedance of the load applied to the crystal rises above a predetermined level.

20 Claims, 7 Drawing Figures

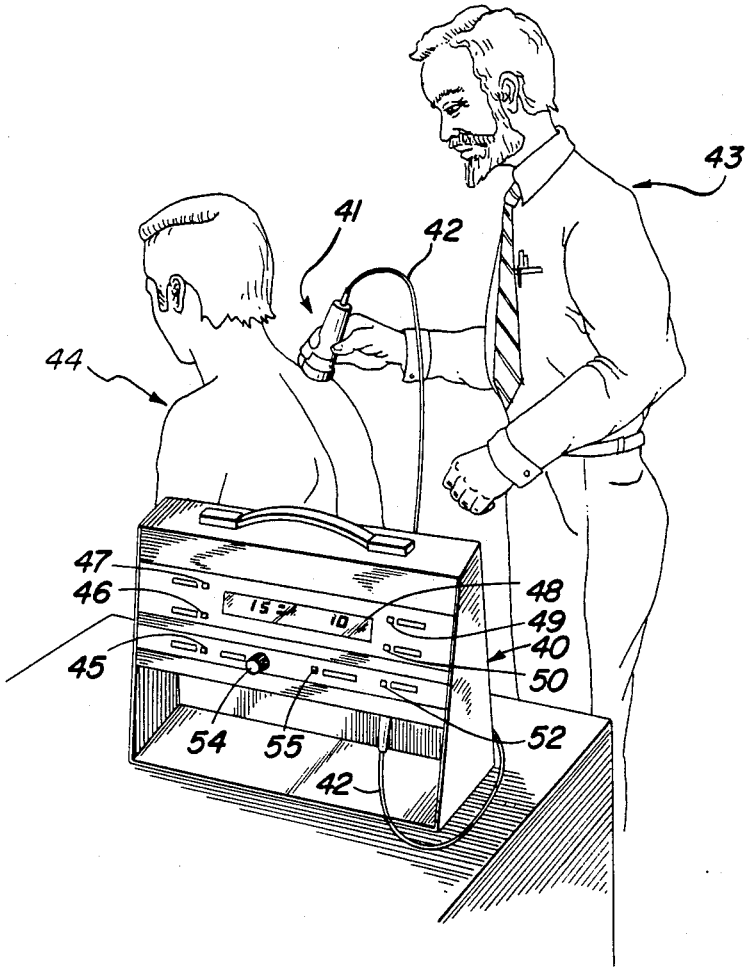
FIG. 1
FIG. 2
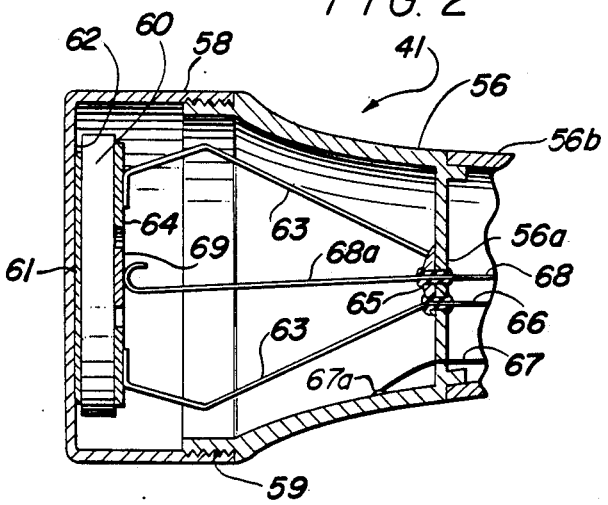
FIG. 3
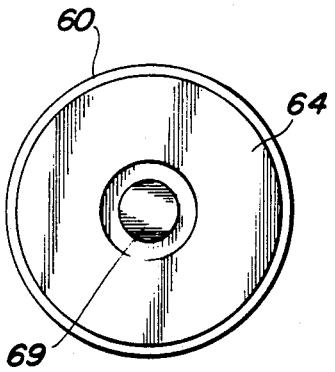

ULTRASONIC GENERATING SYSTEM WITH FEEDBACK CONTROL

BACKGROUND OF THE INVENTION

1. Field of the Invention

This invention relates to ultrasonic generating systems, and more particularly to such systems which are designed for diagnostic and therapy uses.

2. Brief Description of the Prior Art

Ultrasonic generating systems are in widespread use in the medical field and other fields. In medicine, ultrasonic equipment has many applications, including diagnostic and therapy uses. Conventional ultrasonic generating systems designed for medical applications include an ultrasonic transducer in the form of a piezoelectric crystal mounted in a hand-held applicator and a power supply for supplying a high frequency voltage to the transducer. The crystal is normally in the shape of a disc and mounted on a circular end plate which is pressed against the surface of a patient's skin. The crystal is made to oscillate by the application of the high frequency voltage across the electrodes carried on opposite surfaces of the disc. Each crystal has a resonant frequency, and to optimize the output of the crystal the frequency of the applied voltage is set at the resonant frequency.

The amount of energy transmitted by the crystal transducer is dependent upon the amplitude of the high frequency applied across its electrodes and upon the load applied thereto. The amplitude of the voltage is normally subject to adjustment by the operator. However, the magnitude of the load is dependent upon the degree to which the transducer is coupled to the patient's skin. Where the transducer is separated from the patient's skin by air or a coupling substance with poor ultrasonic transmissiveness, the impedance presented to the crystal will be high and little or no energy will be transmitted to the patient. Water, saline solutions and gels (having good ultrasonic transmissiveness) provide good coupling between the transducer and the patient.

In therapeutic applications, treatment is normally based on the power of voltage applied to the transducer and the application time. An improper coupling of the transducer to the patient's skin during treatment reduces the amount of ultrasonic energy actually transmitted to the patient, thereby providing less than the prescribed treatment for a given application time.

In addition to the need to ensure that the prescribed amount of ultrasonic energy is transmitted to the patient, there is a need to ensure that the oscillator frequency is maintained at the resonant frequency of the transducer crystal. In prior art ultrasonic generating systems the oscillator for driving the crystal is tuned by the manufacturer after the entire system is assembled. Crystal replacement or aging of the electronic components in the power supply frequently requires that the oscillator be returned, a task normally performed by the manufacturer at the factory. Shipment of the system back to the manufacturer for such retuning is time consuming, expensive and removes the equipment from the operative status.

The present invention overcomes the above problems.

SUMMARY OF THE INVENTION

In accordance with the present invention, an ultrasonic generating system is provided for coupling vibratory energy into a load such as living tissue for therapeutic purposes. The system includes a piezoelectric crystal having opposing faces with an excitation electrode disposed on each face. Power supply means are provided for applying an alternating current (ac) output voltage to the excitation electrodes to cause the crystal to oscillate and produce vibrations. Feedback means including a feedback electrode disposed on one of the crystal faces provides a feedback signal representative of the frequency and magnitude of the vibratory energy applied to the load. The feedback signal may be utilized to slave the frequency of the output voltage from the power supply to the resonant frequency of the crystal. In addition, the feedback signal may be employed to disable the power supply means when the load impedance rises above a predetermined level (i.e., energy applied to the load decreases below a preset amount).

The crystal feedback means may include one of the excitation electrodes and an additional electrode disposed on the face of the crystal opposite from said one excitation electrode.

BRIEF DESCRIPTION OF THE DRAWINGS

FIG. 1 is a perspective view illustrating an ultrasonic therapeutic unit in accordance with the present invention with an operator applying ultrasonic energy to a patient by means of a hand-held applicator;

FIG. 2 is a cross-sectional view partially broken away of the hand-held applicator of FIG. 1 showing the transducer and electrical contacts;

FIG. 3 is a top plan view of the transducer utilized in the applicator of FIG. 3 showing the placement of the top electrodes;

DESCRIPTION OF THE PREFERRED EMBODIMENT

Figure 4:
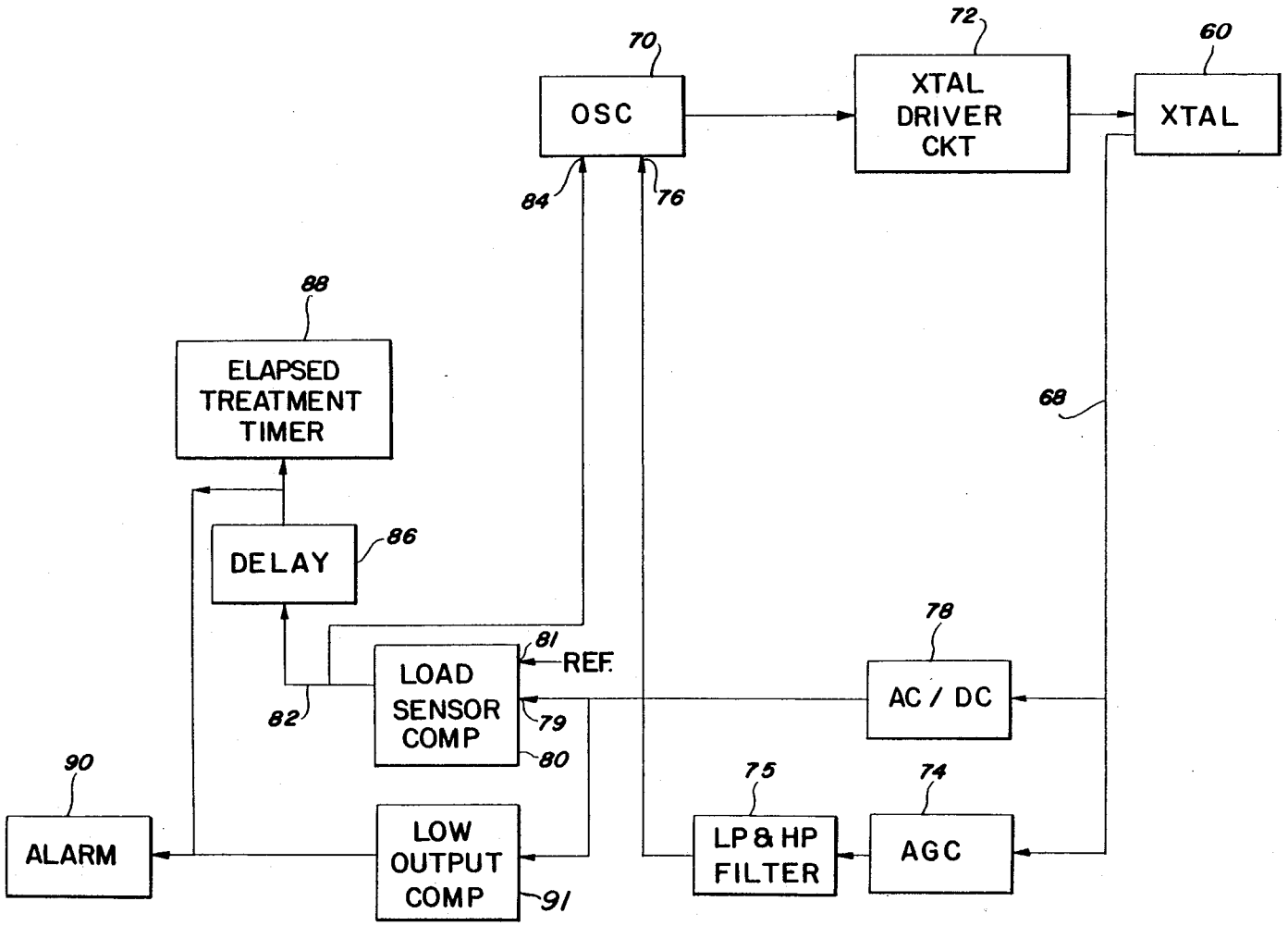
FIG. 4 is a block diagram of a circuit for use in the ultrasonic unit of FIG. 1.

Referring now to the drawings where the same elements in the several figures are identified by the same reference numerals, and particularly to FIG. 1, the ultrasonic engineering system of the invention includes an electrical generating unit or power supply 40 and a hand-held applicator 41. A suitable cable 42 contains the conductors which carry current from the power supply to the applicator. An operator 43 is illustrated as pressing the applicator against the upper back area of a patient 44. The generating unit 40 includes a treatment in progress window 45 which transmits light in a continuous manner from a light-emitting diode (to be described) when the applicator is coupling vibratory energy to the patient. A switch 46 allows the operator to select a pulsed mode or continuous mode of operation, as will be explained in more detail, and switch 47 allows the operator to select an applied power display (through window 48) in watts or watts per square centimeter (watts/cm$^2$). A numeric display of the remaining treatment time may also be observed through window 48, as will be discussed. A switch 49 allows the operator to set the desired treatment time, and a reset switch 50 is used to reset the timer. A switch 52 enables a warning signal generator such as a buzzer to be operated under certain conditions to be explained. A potentiometer 54 allows the operator to set the desired output power, and a window 55 transmits light from a light-emitting diode when power is being supplied to the unit.

Referring now to FIG. 2, there is illustrated a cross-sectional view of the front portion of the hand-held applicator 41. The applicator 41 includes rear housing portions 56 and **56*b* and a front housing portion 58. The housing portions 56, 56*b* and 58 may be made of a suitable conductive material such as aluminum. A disc-shaped transducer in the form of a piezoelectric crystal 60 (having an area, for example, of 10 $cm^2$) includes a circular ground electrode 61 deposited on the front face thereof. The crystal is secured to the inner face 62 of the front housing portion 58 by a suitable conductive cement so that the current can flow between the housing 58 and the ground electrode of the crystal. A pair of spring contacts 63 are secured to a flange 56*a* formed on the rear housing member 56 by means of a suitable insulating material 65. The spring contacts 63 are pressed against an annular high voltage electrode 64 located on the rear face of the crystal, as shown. A pair of power supply conductors 66 and 67 (within the cable 42) connect the excitation electrodes (64 and 61) of the crystal to the power supply 40. The ground conductor is suitably secured (e.g., by a screw) to the housing 56 at 67*a* to carry the gound current to the ground electrode 61 via the conducting housing portions 56 and 58. A third spring contact 68*a* engages a circular feedback electrode 69 located in the center of the rear face of the crystal 60. Each of the electrodes 61, 64 and 69 may be formed by conductive coatings formed on the faces of the crystal 60. When the crystal is vibrating, a feedback signal generated across the feedback and ground electrodes (69 and 61) is carried to the power supply unit 40 by a feedback conductor 68 and the ground conductor 67. The feedback electrode 68 is also included in the cable 42**.

FIG. 3 is a view of the rear face of the crystal 60 and shows the annular high voltage excitation electrode 64 and the circular feedback electrode 69.

Referring now to FIG. 4, there is illustrated a block diagram of a circuit for generating the ultrasonic energy to be applied to the patient via the applicator 41. An oscillator 70 is arranged to generate an electrical signal having a frequency appropriate for driving the crystal 60 through an amplifier or driver circuit 72. The crystal (ac) feedback signal on lead 68, which is representative of the frequency and magnitude of the vibrational energy transmitted by the crystal to the load, such as the tissue of the patient shown in FIG. 1, is applied to an automatic gain control circuit (AGC) 74. The ground lead 67 is not shown in FIG. 2. The ac feedback signal is also applied to an ac/dc converter 78.

The output of the AGC circuit 74 is applied to a frequency control input 76 of the oscillator 70 via a high and low pass filter 75. The feedback signal on lead 68 includes a component having a frequency equal to the resonant frequency of the crystal 60 and components having frequencies equal to the harmonics of the resonant frequency. The harmonic frequencies are filtered out by the low and high filters, leaving a feedback component with the crystal resonant frequency to be applied to the frequency control input 76 of the oscillator 70. The oscillator 70 locks onto the resonant frequency component applied to its frequency control input 76 and generates an output signal to the crystal driver circuit having the resonant frequency of the crystal and a phase relationship with respect to the input signal of $n \times 180°$, where n is an integer. This self-tuning feature permits the crystal to be replaced in the field, or otherwise, without requiring the oscillator to be retuned.

In addition to its use to tune the oscillator circuit 70, the feedback signal is employed to disrupt power to the crystal and stop the treatment timer when the crystal is unloaded, e.g., when the crystal is not appropriately coupled to the skin of the patient. To accomplish these objectives, the feedback signal on lead 68 is converted to a dc voltage signal via the ac/dc converter 78 and applied to one input 79 of a load sensor comparator 80. A reference voltage is applied to the other input 81 of the comparator 80. The amplitude of the feedback signal on lead 68 varies inversely with the magnitude of the load coupled to the crystal 60. Thus, when the crystal is tightly coupled to a patient's skin by means of an appropriate coupling agent, etc., the amplitude of the feedback signal is low. When the crystal is exposed to air because of a poor crystal-skin interface (e.g., poor transmissiveness of the interface solution or a tipping of the applicator relative to the skin surface), the amplitude of the feedback signal is high. When the feedback signal applied to input 79 of the comparator 80 exceeds the amplitude of the reference voltage (indicative of a high impedance load on the crystal), an output signal is generated by the comparator on lead 82. This output signal is applied to a disable input 84 of the oscillator 70 and to a delay circuit 86. The application of an output signal to the disable input 84 turns the oscillator off, thereby shutting off power to the crystal and allowing the feedback signal on lead 68 to go low (e.g., 0 volts). A low level feedback signal on input 79 of the load sensor comparator 80 removes the output signal on lead 82, thereby enabling the oscillator 70, which in turn applies power to the crystal 60. This action will repeat itself until the crystal 60 is subjected to a low impedance load (e.g., proper coupling to the patient's skin) or until the power to the ultrasonic generating system is shut off by the operator.

To inform the operator that the crystal is not properly loaded, an alarm 90 (visual and/or aural) is triggered by the comparator output signal after an appropriate time delay provided by the delay circuit 86. An output from the delay circuit 86 also disables an elapsed treatment timer 88 so that the timer 88 will register only the time of effective treatment.

A low output comparator 91 receives the dc feedback signal on input 79 and compares the magnitude of the signal with a suitable reference voltage and generates an output for triggering the alarm 90 when the feedback voltage is very low (e.g., 0 v or close to 0 v) indicative of the cable 42 being broken or the crystal 90 being inoperative.

A schematic diagram of circuitry which may be used to perform the functions of the block diagram of FIG. 5 and to accomplish certain additional functions (e.g., providing a pulsed mode or continuous ultrasonic wave output, etc.) will now be described in connection with FIGS. 5, 6 and 7, where the various circuit elements such as transistors (PNP, NPN), gates, inverters-operational amplifiers, diodes, resistors, capacitors and integrated circuits are designated by their conventional symbols.

Figure 5:
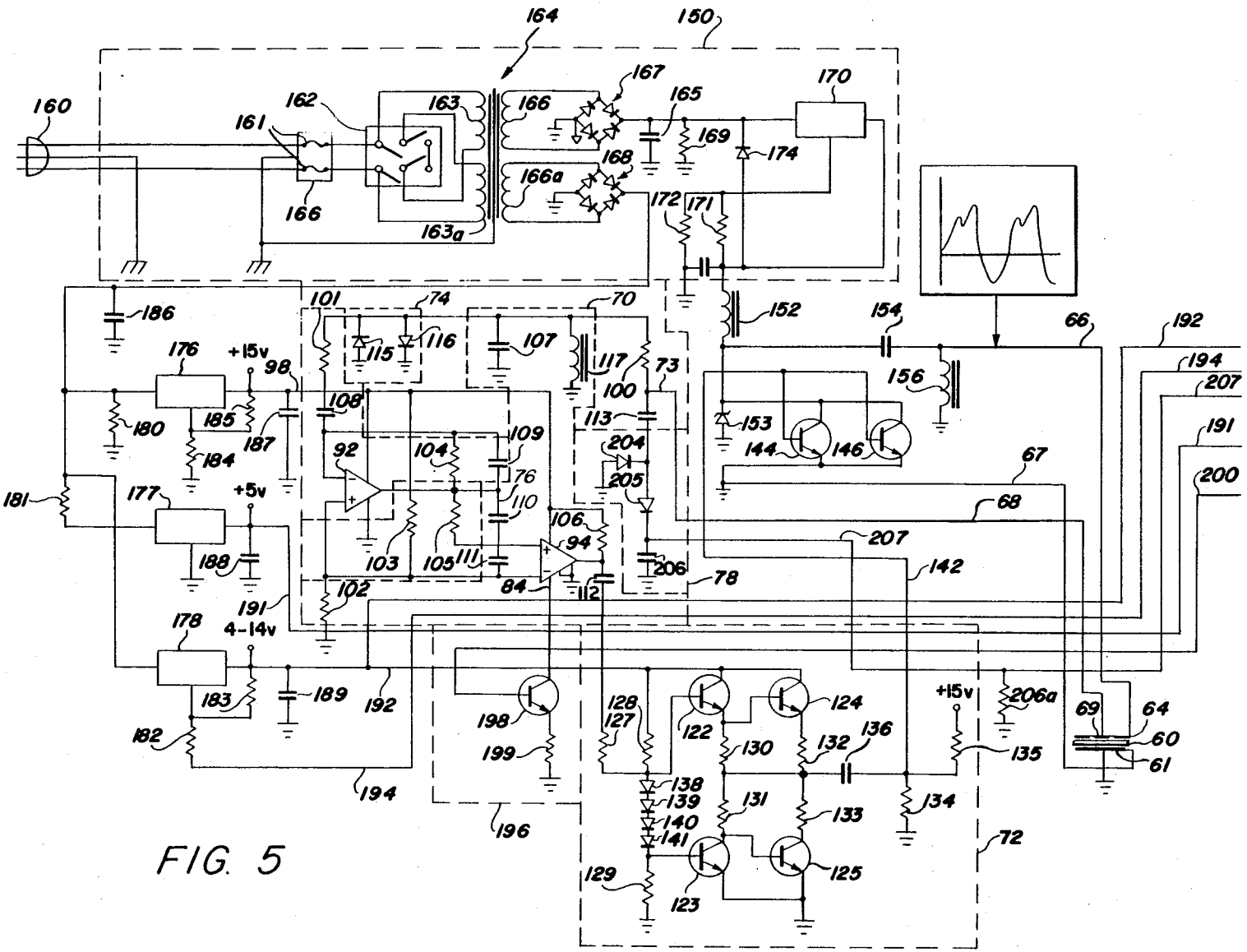
FIG. 5 is a schematic diagram of the transducer and a portion of a circuit for driving the transducer in accordance with present invention.

Referring now to FIG. 5, the oscillator 70 includes an operational amplifier 92 and a comparator 94 connected, as illustrated, for generating a square wave output signal on lead 96. Power is supplied to the amplifier 92 and comparator 94 on conductor 98 from a source of dc current to be described. Resistors 100–106, capacitors 107–113, diodes 115–116 and inductor 117 are connected in the oscillator 70, as shown in FIG. 5.

The output signal from the oscillator 70 is supplied on lead 96 to the crystal driver circuit 72 including transistors 122–125, resistors 127–135, capacitor 136, and diodes 138–141, transistors 144 & 146, zener diode 153, capacitor 154, and inductor 156 connected as shown. The output from the power transistor driver transistors 124 & 125 on lead 142 is applied to the base electrodes of power transistors 144 and 146. Current is supplied to the power transistors from a suitable dc source 150 through a smoothing choke 152. A zener diode 153 serves to limit the maximum voltage applied to the power transistors 144 and 146. The ac output voltage from the power transistors 144 and 146, after being filtered by a capacitor 154 and inductor 156, is applied to the excitation electrodes of the crystal via leads 66 and 67 to cause the crystal 60 to oscillate and produce vibratory energy. The waveform of the output voltage (e.g., 90 v peak-to-peak) from the power transistors in a continuous operation mode (as contrasted with a pulsed mode) is illustrated in the upper right-hand corner of FIG. 5.

The source of dc current 150 includes an ac plug 160 for connection to a standard ac receptacle such as 110 or 240 volts. Suitable fuses 161 connect the plug 160 to a dual switch 162 which supplies current to primary windings 163 and 163*a* of a transformer 164 to accommodate either a 120- or 240-volt supply. Secondary windings 166 and 166*a* are connected to bridge rectifiers 167 and 168, respectively.

The output of the bridge rectifier 167 is filtered by a capacitor 165 and resistor 169 and applied to the choke 152 through a voltage regulator 170. Resistors 171 and 172, capacitor 173, and diode 174 are connected in the circuit as shown. The output voltage from the bridge rectifier 168 is applied to the input of voltage regulators 176, 177 and 178. Resistors 180–185 and capacitors 186–189 are connected to the voltage regulators 176–178, as shown. The supply voltages for the various circuit component in FIGS. 5, 6 and 7 are indicated on the drawings, but for reasons of clarity not all of the connections to the dc source 150 and the voltage regulators 176–178 are shown. The output of the regulator 177 is supplied to certain of the components of the circuits of FIGS. 6 and 7 via lead 191. The voltage regulator 178 supplies a variable output voltage (e.g., 4–14 volts) on lead 192. The magnitude of the voltage output from the regulator 178 is dependent upon the resistance of power setting potentiometer 54 which is connected to lead 194, as will be described in connection with FIG. 7.

Referring again to FIG. 5, an oscillator strobe circuit 196 for applying a disable signal to disable input lead 84 of the oscillator 70 includes a transistor 198 and a resistor 199 connected between the emitter electrode and ground, as shown. The collector electrode of the transistor 198 is connected to the disable input 84 of the oscillator 70, which, in turn, is connected to pin 6 of the comparator 94. The transistor 198 is normally nonconducting, thereby enabling comparator 94 (connected to function as an oscillator), which generates a square wave output of the resonant frequency of the crystal. A positive voltage on the base electrode of transistor 198 (via lead 200) renders the transistor 198 conductive and disables the comparator 94 (and oscillator 70).

The circuit shown in FIG. 5 further includes the ac/dc converter 78 which comprises diodes 204 and 205 and capacitor 206. The ac feedback signal appearing on lead 68 is converted into a dc feedback signal by the converter 78, and the dc feedback signal which appears on lead 207 is supplied to the load sensor comparator 80 which is shown in detail in FIG. 6. A resistor 206*a* is connected between the lead 207 and ground.

Figure 6:
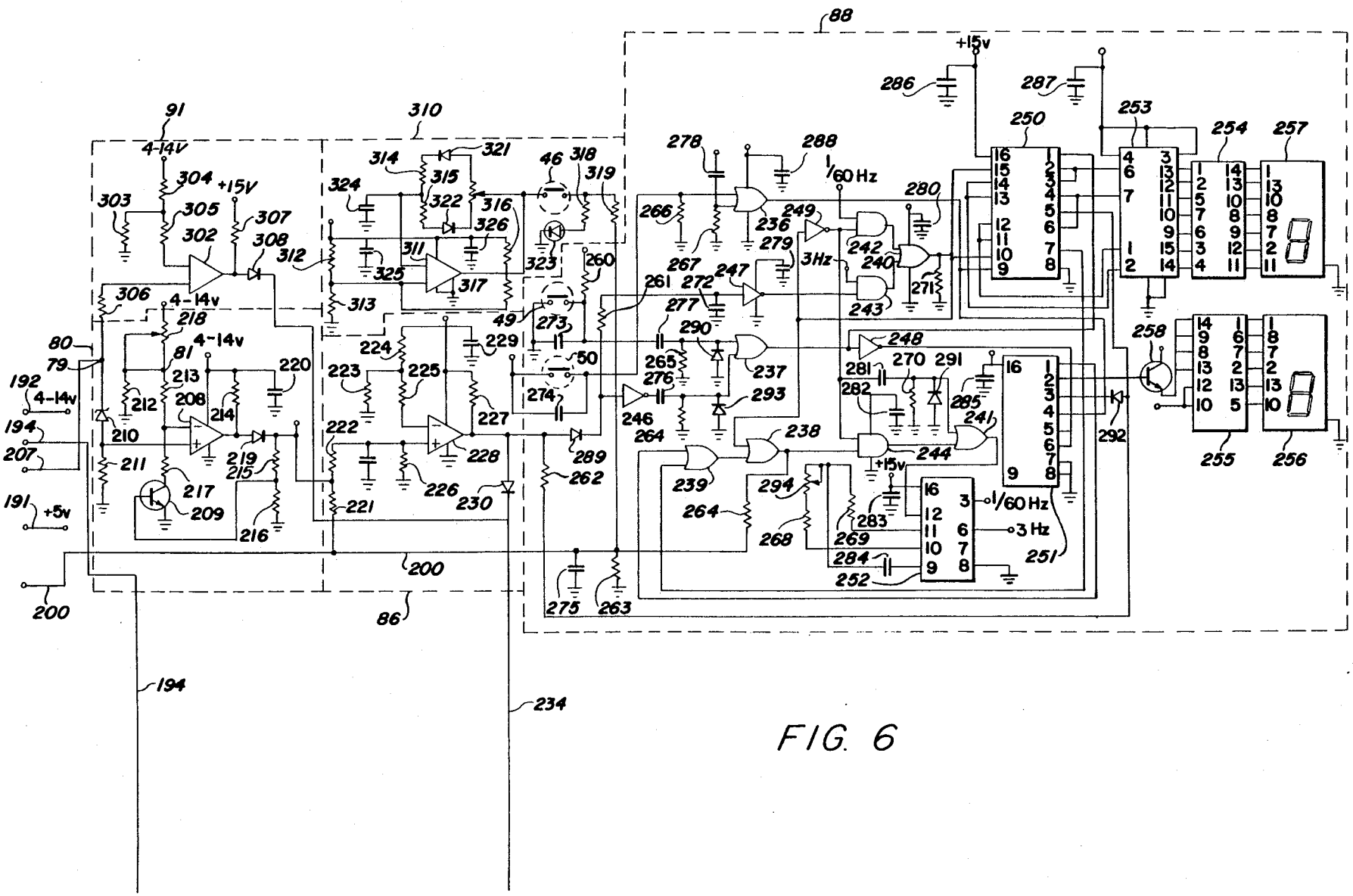
FIG 6 is a schematic diagram of another portion of the circuit for driving the transducer.

Referring now to FIG. 6, the load sensor comparator circuit 80 includes a comparator 208, transistor 209, zener diode 210, resistors 211–217, potentiometer 218, diode 219 and capacitor 220. The zener diode 210 subtracts a predetermined voltage (e.g., 8 volts) from the amplitude of the dc feedback signal appearing on input 79 (lead 207), and the resulting voltage is compared with a preset proportion of the voltage applied to the power transistor-driven circuit 120 (FIG. 5) as determined by the setting on the potentiometer 218. When the dc feedback signal is greater than a predetermined value (as set by potentiometer 218), indicative of the fact that the crystal 71 is not properly loaded, the output of the comparator 208 goes high (e.g., 14 volts) and applies a positive voltage to lead 200 through a resistor 221 to turn on the transistor 198 of FIG. 5, thereby disabling the oscillator 70, as will be more fully described.

The output from the load sensor comparator 80 is also applied to the delay circuit 86. The delay circuit 86 includes an operational amplifier 228, resistors 221 and 223–227, capacitor 229, and diode 230. The delay circuit 86 provides an output to the elapsed treatment timer 88 (FIG. 6) and by lead 234 to a power select circuit 330 and an interrupter circuit 332 (FIG. 7).

The timer 88 includes the set treatment time switch 49, the reset switch 50, OR gates 236–241, AND gates 242–244, inverters 246–249, integrated circuits 250–257, transistor 258, resistors 260–271, capacitors 272–288, diodes 289–293 and potentiometer 294, connected as shown. Integrated circuits 250–257 comprise a counter (250), a flip-flop (251), a clock generator (252), resistance units (253 and 254), and seven segment liquid crystal displays (256 for tens and 257 for units).

A low power comparator 91 (FIG. 6) compares the dc feedback signal on lead 207 with a predetermined proportion of the output voltage and provides an output on lead 234 when the feedback voltage is close to zero indicative, for example, of a broken cable between the generator and the hand-held applicator. The low output comparator 300 includes a comparator 302, resistors 303–307 and diode 308.

A pulsed mode oscillator 310 for providing pulsed oscillation includes a comparator 311, resistors 312–319, potentiometer 320, diodes 321 and 322, light-emitting diode 323, capacitors 324–326, and pulsed mode switch 46. When switch 46 is activated, the oscillator 320 applies a square wave (having a high level for 8 ms and a low level for 2 ms) to the lead 200 to turn the transistor 198 (FIG. 5) on and off, thereby enabling the oscillator 70 (FIG. 5) at a 20% duty cycle.

Figure 7:
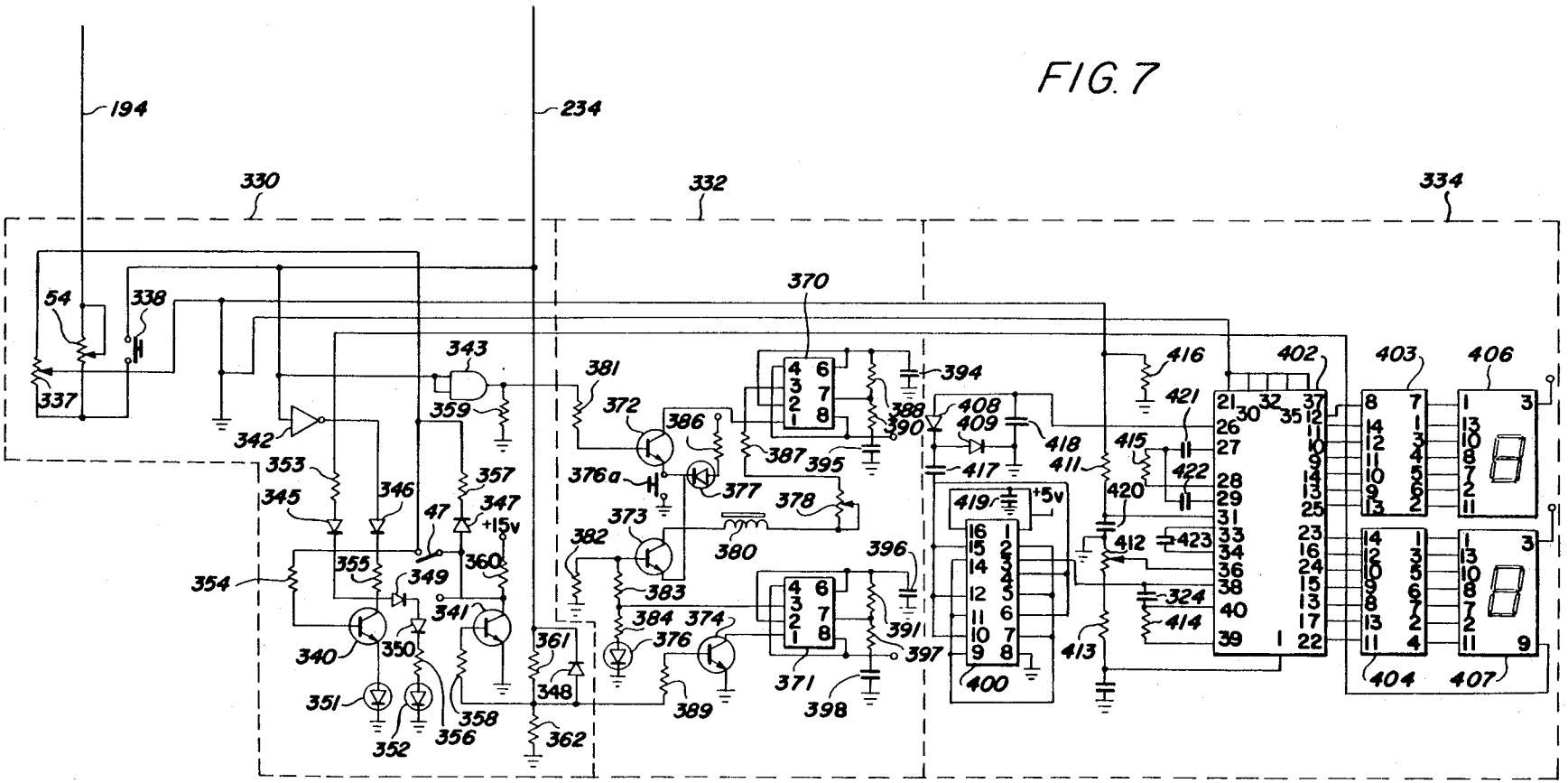
FIG. 7 is a schematic diagram of the remainder of the circuit for driving the transducer in accordance with the present invention.

Referring now to FIG. 7, there is illustrated the power selection circuit 330, the interrupter circuit 332 and a power meter 334. The power selection circuit 330 includes power select potentiometer 54 which controls the resistance to ground on the lead 194 and thereby sets the output voltage of the voltage regulator 178 (FIG. 5)

at a value of between 4 and 14 volts. A second potentiometer 337 functions as a voltage divider to adjust the voltage supplied to the power meter in accordance with the voltage output from the regulator 178. A switch 338, when activated, disables the interrupter circuit 332 so that the output power can be set and read on the power member before treatment starts, as will be described. The power select circuit 330 further includes transistors 340 and 341, inverter 342, gate 343, diodes 345–350, light-emitting diodes 351 and 352, resistors 353–362, and the power display switch 47, connected as shown.

The interrupter circuit 332 includes integrated circuits (oscillators) 370 and 371, transistors 372–374, light-emitting diodes 376 and 377, potentiometer 378, alarm coil 380 (for activating the alarm 90 of FIG. 4), resistors 381–392, and capacitors 394–397, connected as shown.

The power meter 334 includes a hex buffer/converter integrated circuit 400, an a/d converter integrated circuit 402, integrated circuit resistance units 403 and 404, seven segment liquid crystal display circuits 406 (units) and 407 (tens), diodes 408 and 409, resistors 411–416, and capacitors 417–424, connected as shown. The hex buffer/converter 400 receives an ac signal from pin 38 of the a/d converter 402 and converts the ac signal to 5 vdc by means of the diodes 408 and 409 and the capacitor 418. The 5 vdc is supplied as the operating voltage to terminal 26 of the a/d converter 402.

The operation of the system of FIGS. 5, 6 and 7 will now be described. The operator initially selects the mode of operation, that is, continuous or pulsed mode, by means of switch 47 (FIGS. 1 and 7). When actuated, this switch connects the pulsed mode oscillator 310 output to lead 200. When the output is high, the transistor 198 (FIG. 5) is turned on disabling the comparator unit 94 (and oscillator 70) and cutting off power to the crystal 60. When the output from the pulsed mode oscillator 310 is low, power to the crystal is restored. Thus, in the pulsed mode, the crystal sees bursts of high frequency excitation energy. When the switch 47 is not activated, continuous high frequency energy is supplied to the crystal.

The operator must also select the desired treatment power and time. The power is selected by depressing the power select switch 338 (FIG. 7) to render transistors 341 and 374 inoperative. Transistors 374, when turned on by the low output comparator 300 or a delayed output from the load sensor comparator 80 (FIG. 7) when no load is being applied to the crystal, as will be discussed subsequently, activates visual and aural alarms 377 and 380 (FIG. 7). Activation of switch 338 prevents the activation of such alarms and thereby allows the operator to set the treatment power with the crystal in an unloaded condition. The transistor 341, when turned on (with switch 47 closed) by a high level signal on lead 234, places ground potential on the slider of the potentiometer 337, which causes the power meter 334 to read 0 watts. By keeping the transistor 341 in a nonconducting state with switch 338, the power meter will display a true reading of the treatment power as set by the potentiometer 336. As discussed previously, potentiometer 54 adjusts the output voltage (4–14 volts) from the voltage regulator 178 (FIG. 5) to the transistor power driver circuit 120 which controls the output power from the power transistors 144 and 146. Potentiometer 337 acts as a voltage divider to supply a voltage to the power meter circuit (pins 31, 36 and 1 of the a/d converter 402), which is representative of the power supplied to the crystal. The seven segment displays 406 and 407 provide a numerical display of the power in units and tens, respectively, in a conventional manner.

Prior to the commencement of treatment, the operator must also select the desired power meter reading, that is, in watts or watts/cm$^2$. Switch 364 (FIGS. 1, 7) is used for this purpose. In its open position, switch 364 maintains transistor 340 in a nonconducting state, thereby allowing current to flow through light-emitting diode 352, which informs the operator that the meter reading is in watts. In its closed position, switch 364 turns on transistor 340 which shunts the current from diode 352 to 351, thereby informing the operator that the meter reading is in watts/cm$^2$. Operation of the transistor 340 also places a low voltage on pin 9 of the seven-segment display unit 407, which adds a decimal to the reading. Thus, instead of displaying 10 (watts), the meter will display 1.0 (watts/cm$^2$). The use of a decimal to convert a reading in watts to watts/cm$^2$ is appropriate since the area of the crystal 60 is 10 cm$^2$.

Before commencing treatment, the operator must further select the treatment time by holding the set time switch 49 (FIG. 6) down until the up/down counter 250 counts up to the desired time (e.g., 0–19 minutes). When the set time switch 232 is pressed, a 3 Hz signal generated by the clock generator 252 is applied to pin 15 of the counter 250 via AND gate 243 to cause the converter to advance three minutes for each second of elapsed time. When the switch 232 is released a 1/60 Hz signal from the clock generator 251 is applied to pin 15 of the counter 250 to cause the counter to count down in real time. When the timer readout (displays 256 and 257) is at zero minutes (i.e., end of treatment), the output from gate 238 goes high. This high-level signal is applied to lead 200 and turns on transistor 198 and oscillator 70, as will be explained more fully in connection with the description of the load sensor comparator. Reset switch 234, when pressed, resets the timer 88 to zero.

The self-tuning feature of the system will now be described in reference to FIG. 5. Without a feedback signal from the crystal 60 on lead 68, the oscillator circuit 70, and specifically the comparator 94 therein, operates as a free-running oscillator and generates a square wave having a frequency of about 3 MHz. This signal, after being amplified by the power transistor driver circuit 120 and the power transistors 144 and 146, is applied to the excitation electrodes 61 and 64 of the crystal 60. The dominant frequencies in the feedback signal generated by the crystal (across the ground and feedback electrodes 61 and 69) are the resonant crystal frequency (1 MHz) and its harmonics. This feedback signal on lead 68 is applied to the inverting input of amplifier 92 through a tuned circuit (inductor 117 and capacitor 107), and AGC circuit (diodes 115 and 116), and a high pass filter (resistor 101 and capacitor 108). The amplifier 92 operates as a low pass filter with a cutoff frequency of 1 MHz (determined by the values of resistor 104 and capacitor 109). As a result of the various filters the output signal from amplifier 92 has a frequency equal to the resonant frequency of the crystal 60 and a phase relationship of $n \times 180°$ with respect to the feedback input signal where n is an integer. This output signal applied to the comparator 94 slaves the oscillator 70 to that frequency. The oscillator circuit 70, power transistor driver circuit 120, and the power transistors (144 and 146) are arranged so that the high frequency voltage supplied to the crystal 60 is in phase with the feedback signal with the gain around the feedback loop substantially at unity. The ac feedback signal from the crystal permits the system to be self-tuning, thereby enabling an operator to replace the crystal 60 without changing the values of the circuit elements in the oscillator circuit 70.

In addition to synchronizing the oscillator frequency with the resonant frequency of the crystal, the feedback signal is used to disable the oscillator 70 and the treatment timer 88 when the crystal 60 is inadequately loaded. For these purposes, the ac feedback signal on lead 76 is converted to a dc feedback signal via diodes 205 and 206 in the ac/dc converter 78 (FIG. 5) and applied to lead 207. The dc feedback signal on lead 207 is compared with a reference voltage by the load sensor 80 (comparator 208, FIG. 6), as previously described. When the feedback signal input to the comparator 208 of circuit 80 is higher than the reference signal applied to the other input of the comparator, the output of the comparator goes high (15 v). This high output signal is applied to lead 200 and biases the transistor 198 (FIG. 5) on to disable the comparator 94 and oscillator circuit 70. In this condition, the oscillator circuit 70, power transistor driver circuit 120 and power transistors (144 and 146) cease applying excitation voltage to the crystal 60, which causes the feedback signal on lead 69 to fall to zero. As soon as the feedback signal present at the positive input of the comparator 208 (FIG. 6) drops below the reference voltage present at the negative input (as a result of discharging through resistors 214 and 216), the output of the comparator 208 goes low (0 v) allowing the transistor 198 to turn off and enabling the oscillator circuit 70. If the crystal remains unloaded, the cycle repeats itself at a rate (e.g., 60–100 ms) determined by the resistance elements discussed above.

The output signal from the load sensor comparator 80 is also applied to timer 86 through the time delay circuit 86, as illustrated. If crystal remains unloaded for a preset time (e.g., 3–5 seconds as determined by the components in the delay circuit 86), the output of comparator 22 in the delay circuit goes high. This high level output is applied to pin 5 of the counter 250 via resistor 262, stopping the counter and the elapsed treatment timer display (256, 257) at that moment's count. A high level output from the delay circuit 86 is also applied to the base of transistors 341 and 374 (FIG. 7) via diode 230 and lead 234, turning these transistors on. Transistor 341, when conducting, pulls the voltage at the non-grounded end of potentiometer 337 low (0 v) to cause the power meter to display 0 watts or watts/cm$^2$. Transistor 374, when conducting, turns oscillator 371 on, thereby causing current to flow intermittently through the treatment in progress light-emitting diode 376. The output from the oscillator 371 also turns the transistor 373 on. A high level signal on lead 234 also turns transistor 372 on via AND gate 343, thereby activating the audio alarm coil 380 at the same rate as the treatment in progress indicator 376, assuming that the activate alarm switch 377*a* is closed. A light-emitting diode 377 informs the operator that the activate alarm switch 378*a* is closed.

The low output comparator circuit 91 (FIG. 6) compares the ac feedback voltage on lead 207 with a reference voltage and provides a high-level output (from comparator 302) when the feedback voltage is substantially zero indicating that the crystal is defective or that one or more of the leads between the applicator 44 and the generator 40 are broken. This high-level voltage is also applied to lead 234 and accomplishes the same functions of activating the alarms and causing the power meter to display 0 watts, as was explained with respect to a high-level output from the delay circuit 86.

An example of the values for the circuit components illustrated in FIGS. 5, 6 and 7 is set forth below.

| Component Numbers | Part Numbers as Manufactured by National Semiconductor, Motorola, Etc. |
|---|---|
| | INTEGRATED CIRCUITS, OPERATIONAL AMPLIFIERS AND COMPARATORS |
| 250 | CD4510BE (Up/Down Counter) |
| 251 | CD4027 (Dual Flip-Flop) |
| 252 | CD4060BFX (Counter) |
| 253 | CD4511BE (Binary Code to Decimal Converter) |
| 254, 255 | DIP Resistor, 2.2KΩ (37 K") |
| 256, 257 | 5082-77670 |
| 370, 371 | NE555 (Timer) |
| 400 | CD4009 (EX BUFF Conv.) |
| 402 | CL7107 5082-7760 (LED 7-Seg.) |
| 403, 404 | U218, 47Ω (DIP Resistor 47) |
| 406, 407 | DS202 5082-771 (LED 7-Seg.) |
| 92 | 3140 (OP AMP) |
| 94 | 311 (Comparator, 8-Pin DIP) |
| 208, 302 | LM311N (Dual Comparator) |
| 228 | LM941CN (OP AMP |
| 311 | LM311N (Comparator) |
| | VOLTAGE REGULATORS |
| 170 | LM317 HVK (40v) |
| 176, 178 | LM317 T (5v) |
| 177 | 7805 (2-37v) |
| | TRANSISTORS |
| 123 | 2907A |
| 124 | MPS UO5 |
| 125 | MPS US5 |
| 144, 146 | 2N5038 |
| 122, 198, 209, 258, 340, 341, 372, 373, 374 | 2N2222A |
| | GATES AND INVERTERS |
| 236, 238, 241 | CD4071B |
| 237, 246, 247, 248, 249, 342 | CD4069B |
| 239, 240 | CD4001BFX |
| 242, 243, 244 | CD4081BF |

| Component Numbers | Resistance Value |
|---|---|
| | RESISTORS |
| 54 | 1K Potentiometer |
| 103, 212, 216 218, 224, 304, 314, 413, | 10K |
| 104, 105, 221 | 15K |
| 106 | 1.5K |
| 127, 185 | 220Ω |
| 128 | 6.8K |
| 129 | 6.3K |
| 130, 131, 353 | 100Ω |
| 132, 133 | 10Ω |
| 134 | 47Ω |
| 135, 213, 223, 303, 305, 306, 312, 313, 315, 361, 388, 389 | 4.7K |
| 169, 180, 383 | 3.3K |
| 171 | 220Ω |
| 172 | 7.5K |
| 181 | 68Ω |
| 182, 225, 316, 356 | 470Ω |
| 183 | 150Ω |
| 184 | 2.7K |
| 199, 227, 260, 307, 318, 355 358, 384 | 1K |

-continued

| | |
|---|---|
| 206a | 2.2MΩ ("M") |
| 211, 397, 415 | R215, 1 M |
| 217 | 39K |
| 222, 225, 226 | R210, 470K |
| 266, 267, 412 | |
| 261, 414 | 100K |
| 263, 264, 319, | 2.2K |
| 381, 386, 390 | |
| 265 | 56K |
| 268 | 39K |
| 269 | 2.2K |
| 270, 271 | 56K |
| 337 | 750Ω Potentiometer |
| 354 | 100K |
| 357 | 220K |
| 359 | 56K |
| 362, 382 | 330Ω |
| 387 | 680Ω |
| 391 | 4.7 M |
| 416 | 22K |
| Component Numbers | Capacitance Value |
| | CAPACITORS |
| 107 | 47PF |
| 108, 109, 110, | 10PF |
| 111 | |
| 110 | 22PF |
| 112, 417 | .047 μf |
| 113, 275, 284 | .47 μf |
| 165 | 1000 μf |
| 186 | 470 μf |
| 187, 188, 189, | 10 μf |
| 326, 418 | |
| 206 | 1 μf |
| 220, 229, 276, | .1 μf |
| 278, 279, 282, | |
| 283, 285, 286, | |
| 287, 288, 325, | |
| 394, 395, 396, | |
| 398, 420 | |
| 272 | .01 μf |
| 324 | .33 μf |
| | DIODES |
| 115, 116, 138, | IN914B |
| 139, 140, 141, | |
| 204, 205, 219, | |
| 230, 290, 291, | |
| 292, 293, 308, | |
| 321, 326, 345, | |
| 346, 347, 348, | |
| 349, 350, 408, | |
| 409 | |
| 153 | Zener 150 v |
| 174 | IN4002 |
| 204 | CR107 |
| 205 | CR108 |
| 210 | Zener 8.2 v |
| 351, 352 | LED TR1 |
| 376 | LED |
| 377 | LED |

The above part numbers and values are by way of example only. Those skilled in the art will readily appreciate that other integrated circuits, transistors, etc., may be used to perform the designated function without departing from the invention.

The above description presents the best mode contemplated in carrying out my invention. My invention is, however, susceptible to modifications and alternate constructions from the embodiments shown in the drawings and described above. Consequently, it is not the intention to limit the invention to the particular embodiments disclosed. On the contrary, the invention is intended and shall cover all modifications, sizes and alternate constructions falling within the spirit and scope of the invention, as expressed in the appended claims when read in light of the description and drawings.

What is claimed is:

1. In an ultrasonic generating system for treating living tissue, the combination which comprises:

(a) electrically oscillating means having an input and output and arranged to produce an oscillating signal in the output which has the same frequency as the signal on the input thereof and a phase relationship with respect thereto of $n \times 180°$, where n is an integer;

(b) a piezoelectric crystal for translating ac energy into mechanical vibrations and vice versa, the crystal having excitation electrode means for receiving the ac energy and feedback electrode means for providing a feedback signal representative of the vibrations induced in said crystal;

(c) means for coupling the output of the oscillating means to the excitation electrode means of the crystal; and (d) feedback means including filter means connected between the feedback electrode means and the input of the oscillating means to provide a closed loop around the oscillating means and the crystal, for filtering out harmonics from the feedback signal and for adjusting the amplitude of the feedback signal so that the gain around the loop is approximately unity; whereby the frequency means is slaved to the resonant frequency of the crystals.

2. In an ultrasonic generating system for coupling vibratory energy into a load, the combination which comprises:

(a) a piezoelectric crystal having two opposing faces and being arranged to translate electrical energy into mechanical vibrations and vice versa, the crystal having a resonant frequency;

(b) an excitation electrode disposed on each of said two faces of the crystal;

(c) power supply means for applying an ac output voltage to said excitation electrodes to cause said crystal to produce mechanical vibrations;

(d) feedback means coupled to the crystal for providing a feedback signal representative of the frequency and magnitude of the mechanical vibrations transmitted to the load, the feedback means including at least one feedback electrode disposed on one face of the crystal and filter means to filter out harmonics of the resonant frequency to thereby provide a feedback signal having the crystal resonant frequency; and (e) coupling means for coupling the feedback signal to the power supply means, the power supply means being arranged to lock the frequency of the output voltage thereof to the frequency of the feedback signal.

3. The ultrasonic generating system of claim 2 wherein said crystal is in the form of a flat plate and the excitation electrodes comprise first and second electrodes.

4. The ultrasonic generating system of claim 3 wherein the feedback means includes said first electrode and a third electrode disposed on the opposite face of the crystal from said first electrode.

5. The ultrasonic generating system of claim 4 wherein the electrodes comprise conductive coatings on the faces of the crystal, the first electrode substantially covers one entire face of the crystal, the second electrode is annular in shape and disposed on the other face of the crystal, and the third electrode is disposed inside of the circular opening of the second electrode.

6. The ultrasonic generating system of claim 5 wherein the means for applying the ac voltage to the excitation electrodes includes at least one spring contact in engagement with the second electrode, and wherein the feedback means includes a second spring contact in engagement with the third electrode.

7. The invention of claim 2 including control means responsive to the feedback signal for disabling the power supply means when the impedance of the load rises above a predetermined value.

8. The invention of claim 7 wherein the control means comprises a source of a reference voltage and a comparator means for comparing the magnitude of the feedback signal with the magnitude of the reference voltage and providing an output signal when the magnitude of the feedback signal exceeds the magnitude of the reference voltage.

9. The invention of claim 8 including means responsive to the output signal from the comparator for providing a warning signal indicative of the fact that the load impedance has risen above said predetermined value.

10. The invention of claim 9 wherein means for providing the warning signals produces a signal which may be visually detected by an operator of the ultrasonic generating systems.

11. The invention of claim 9 wherein the means for providing the warning signal produces a signal which may be detected by the auditory senses of an operator of the ultrasonic generating systems.

12. The combination of claim 9 including timing means responsive to the control means for providing a measure of the time that the power supply means is not disabled.

13. The ultrasonic generating system of claim 2 wherein the power supply means includes an electrical oscillator having a control input and an output, the oscillator being arranged in the absence of a signal on the control input to produce an oscillator output signal in the output having a frequency within a predetermined range and in the presence of a signal on the control input to produce an output signal having a frequency equal to the input signal and a phase relationship with respect thereto of $n \times 180°$, where n is an integer, the frequency of the ac output voltage from the power supply means being equal to the oscillator output frequency and wherein the coupling means is arranged to couple the feedback signal to the control input of the oscillator so that the output signal from the power supply is in phase with the feedback signal.

14. The ultrasonic generating system defined in claim 13 wherein the oscillator, crystal, feedback means and coupling means form a closed loop, and the gain around the loop is approximately unity.

15. In a self-tuning ultrasonic generating system, the combination which comprises:

(a) a piezoelectric crystal for translating electrical energy into mechanical energy vibrations and having a resonant frequency;

(b) a pair of excitation electrodes disposed on the crystal and arranged so that an ac voltage applied across the excitation electrodes will cause the crystal to oscillate;

(c) a feedback electrode disposed on the crystal and arranged so that a feedback signal representative of the magnitude and frequency of the crystal vibration is developed between the feedback electrode and one of said excitation electrode when the crystal vibrates;

(d) oscillating means for applying an ac voltage across the excitation electrodes of the crystal to cause the crystal to oscillate and produce said vibrations; and (e) feedback means responsive to the feedback signal for filtering out harmonics of the resonant frequency from the feedback signal and for controlling the oscillating means to maintain the frequency of the ac voltage applied to the crystal at the resonant frequency.

16. The ultrasonic generating system of claim 15 further including means responsive to the magnitude of the feedback signal for disabling the oscillating means so that said ac voltage is not applied across the crystal when the load impedance rises above a predetermined value.

17. The ultrasonic generating system of claim 16 wherein the last-named means includes a source of a reference voltage and a comparator means for comparing the feedback signal with the reference voltage and producing an output signal when the feedback signal exceeds the reference voltage, the output signal being effective to disable the power supply.

18. The ultrasonic generating system of claim 17 further including an elapsed treatment timer and a delay circuit means connected to receive the output signal from said comparator for stopping the timer after said comparator output signal is received for a predetermined time interval.

19. The ultrasonic generating system of claim 18 further including a power meter and means responsive to said output signal from the comparator for causing the power meter to read substantially zero output power when the load impedance has exceeded said predetermined level for a preset time.

20. The ultrasonic generating system of claim 18 further including an alarm and means for actuating the alarm coupled to the delay means whereby the alarm is actuated when the timer is stopped.

* * * * *